US006843701B1

(12) United States Patent
Arnone

(10) Patent No.: US 6,843,701 B1
(45) Date of Patent: Jan. 18, 2005

(54) DESIGN MAKING TOY

(76) Inventor: Michael Arnone, 15 Duncan Ave., Pequannock, NJ (US) 07440

( * ) Notice: Subject to any disclaimer, the term of this patent is extended or adjusted under 35 U.S.C. 154(b) by 0 days.

(21) Appl. No.: 10/603,672

(22) Filed: Jun. 26, 2003

(51) Int. Cl.[7] ..... A63H 33/22
(52) U.S. Cl. ..... 446/146; 446/243
(58) Field of Search ..... 401/195; 472/72; 446/146, 147, 149, 151, 152, 243, 244

(56) References Cited

U.S. PATENT DOCUMENTS 1,321,035 A 11/1919 Harlan
1,617,126 A * 2/1927 Kurten ..... 40/614
2,557,348 A 6/1951 Hornbostel
2,875,553 A 3/1959 Morgan
3,323,491 A 6/1967 Granick
3,892,087 A * 7/1975 Breslow et al. ..... 446/146
4,085,932 A * 4/1978 Hamano ..... 472/61
4,906,216 A 3/1990 Abeshouse
D364,899 S 12/1995 Molenaar et al.
5,752,870 A * 5/1998 Karasawa et al. ..... 446/146

* cited by examiner

*Primary Examiner*—Jacob K. Ackun, Jr.

(57) ABSTRACT

A design making toy includes a housing having a bottom wall, an upper wall and a peripheral wall. A motor is mounted in the housing. An axle coupled to the motor extends upwardly through the upper wall. The motor is adapted for rotating the axle. A platform is attached to the axle such that the axle extends through the platform. The axle is orientated substantially perpendicular to a plane of the platform. A panel has an upper surface and a bottom surface. The panel has a centrally located aperture extending therethrough. The panel is removably positionable on the platform such that the axle extends through the aperture and the upper surface faces away from the platform. The platform may be rotated and a writing utensil positioned against the upper surface such that a spiral design is positioned on the upper surface.

2 Claims, 4 Drawing Sheets

DESIGN MAKING TOY

BACKGROUND OF THE INVENTION

1. Field of the Invention

The present invention relates to design making devices and more particularly pertains to a new design making device for making stickers having swirl designs positioned thereon.

2. Description of the Prior Art

The use of design making devices is known in the prior art. While these devices fulfill their respective, particular objectives and requirements, the need remains for a device that allows a child to make swirl designs which are selectively positionable on stickers.

SUMMARY OF THE INVENTION

The present invention meets the needs presented above by providing a device for holding stickers, or panels, such that the stickers may be rotated such that as a writing utensil is abutted against the sticker, a swirl design is drawn on the sticker.

To this end, the present invention generally comprises a housing having a bottom wall, an upper wall and a peripheral wall extending between the upper and bottom walls. A motor is mounted in the housing. An axle is coupled to the motor and extends upwardly through the upper wall. The motor is adapted for rotating the axle. A platform is attached to the axle such that the axle extends through the platform. The axle is orientated substantially perpendicular to a plane of the platform. An actuator is operationally coupled to the motor for selectively turning the motor on or off. A panel has an upper surface and a bottom surface. The panel has a centrally located aperture extending therethrough. The panel is removably positionable on the platform such that the axle extends through the aperture and the upper surface faces away from the platform. The platform may be rotated and a writing utensil positioned against the upper surface such that a spiral design is positioned on the upper surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
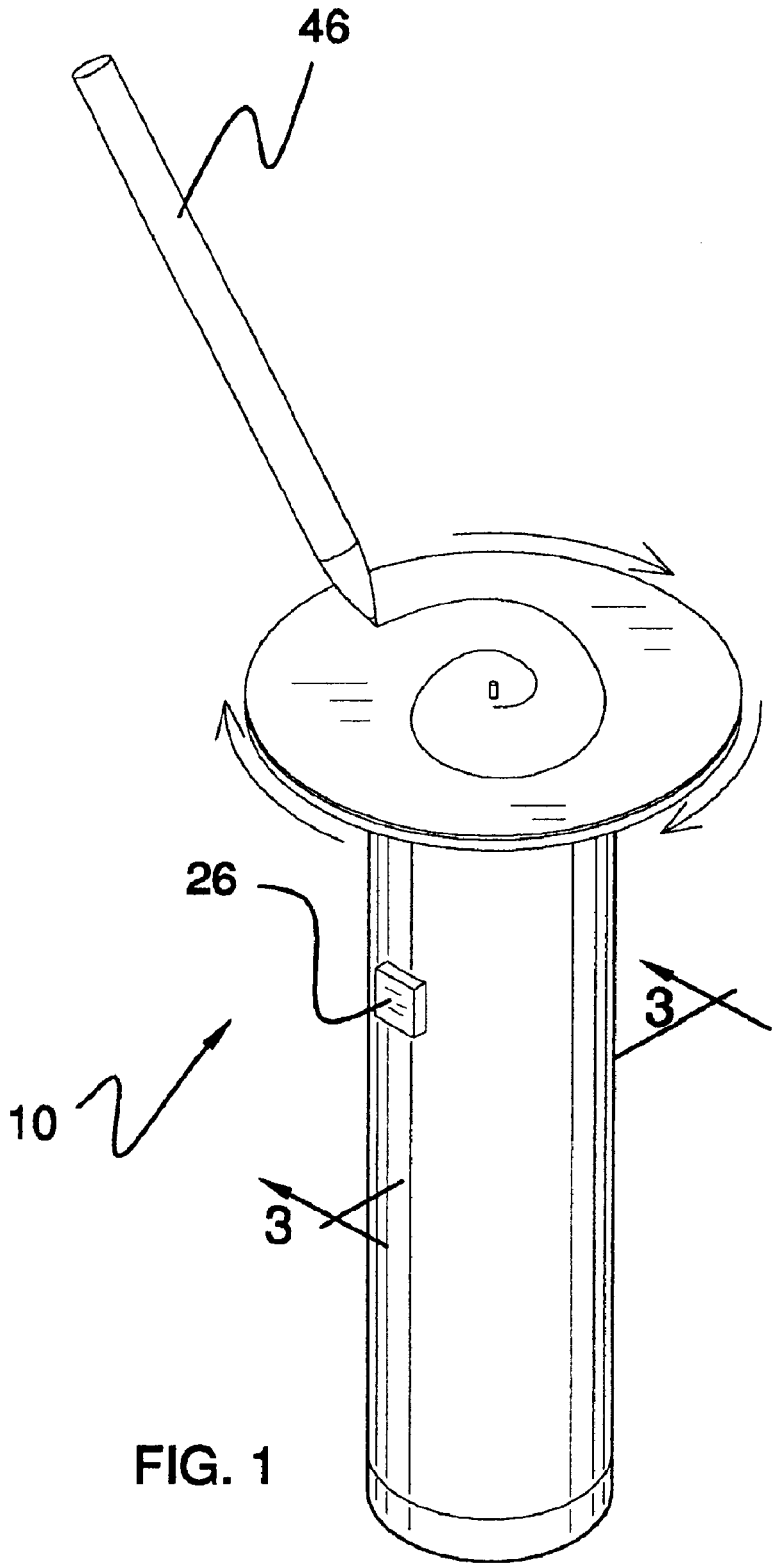
FIG. 1 is a schematic perspective view of a design making toy according to the present invention.
Figure 2:
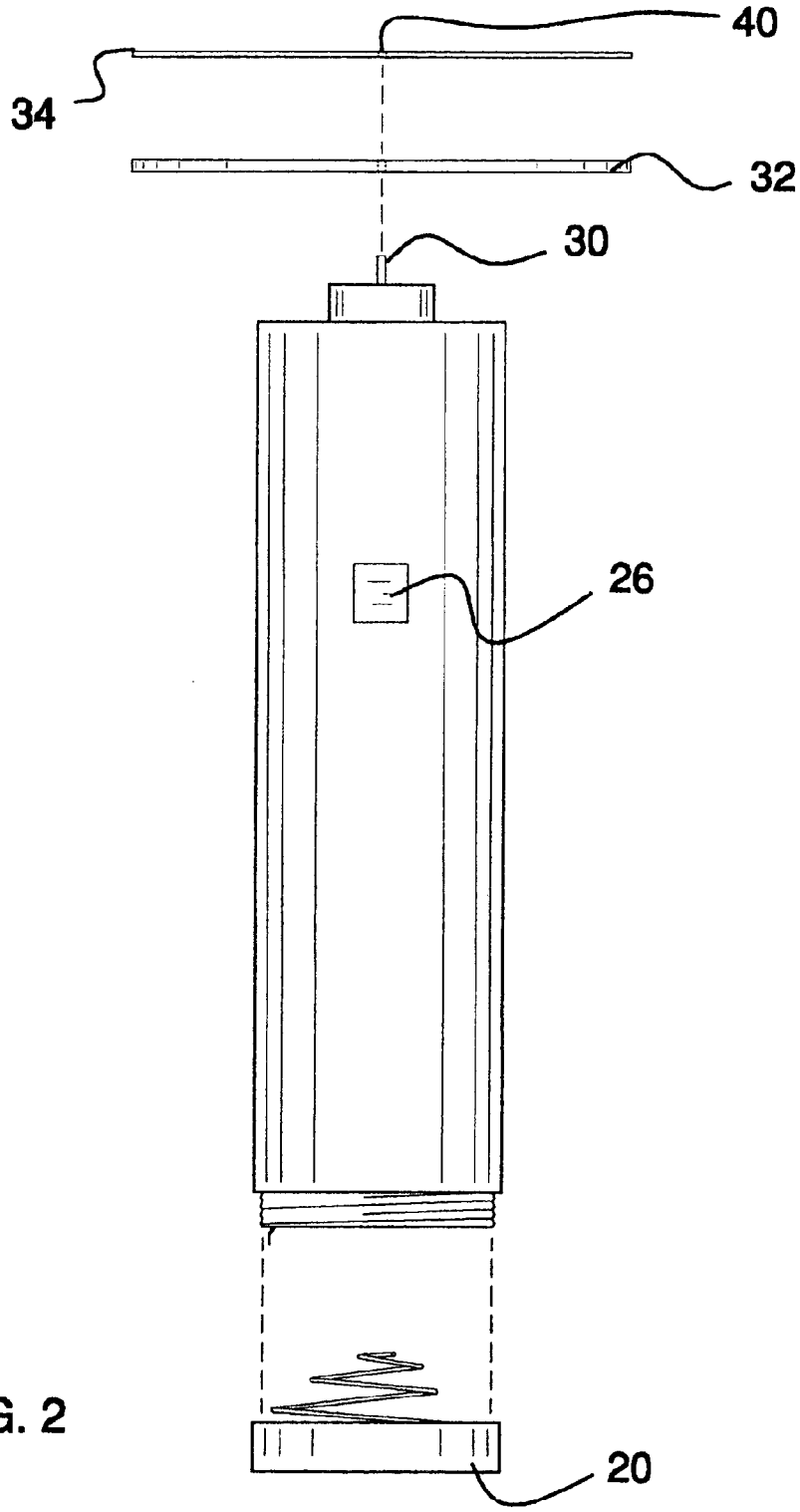
FIG. 2 is a schematic side view of the present invention.
Figure 3:
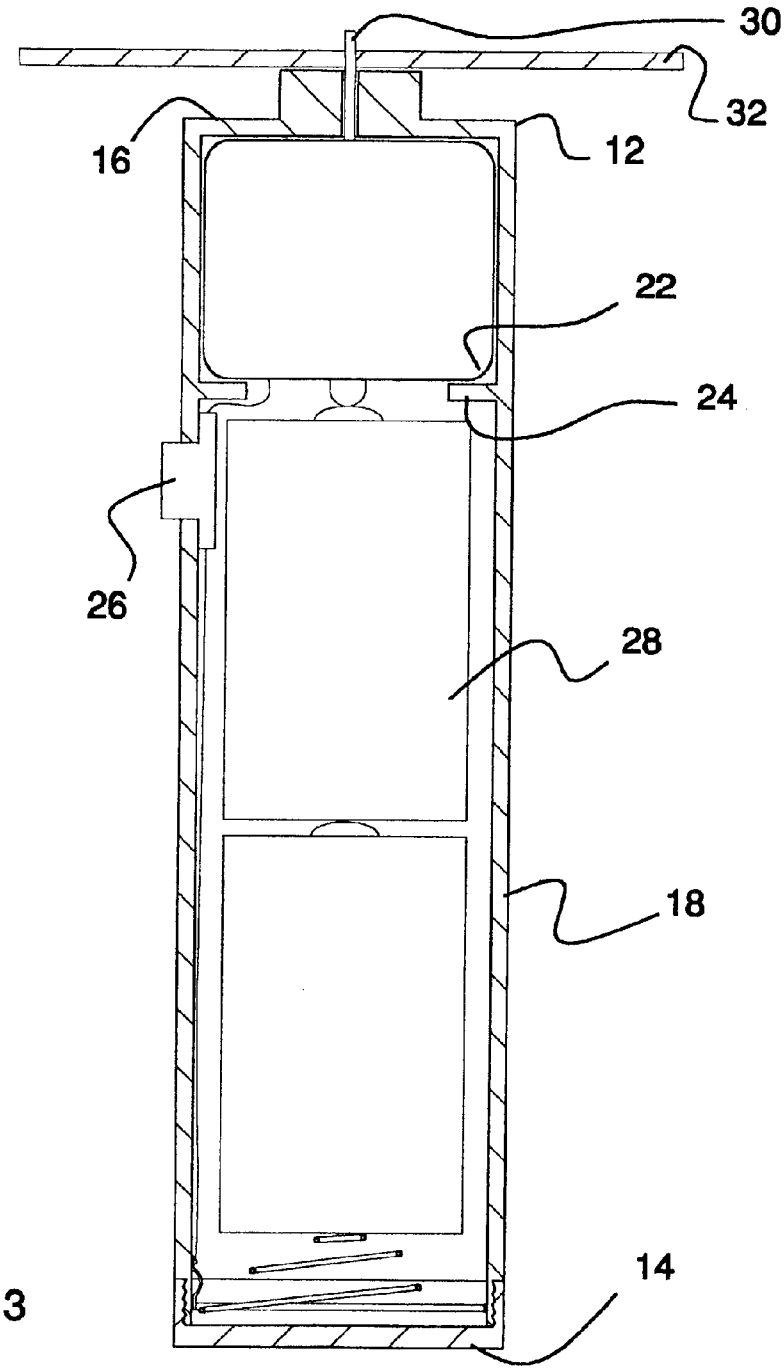
FIG. 3 is a schematic cross-sectional view take along line 3–3 of FIG. 1 of the present invention.
Figure 4:
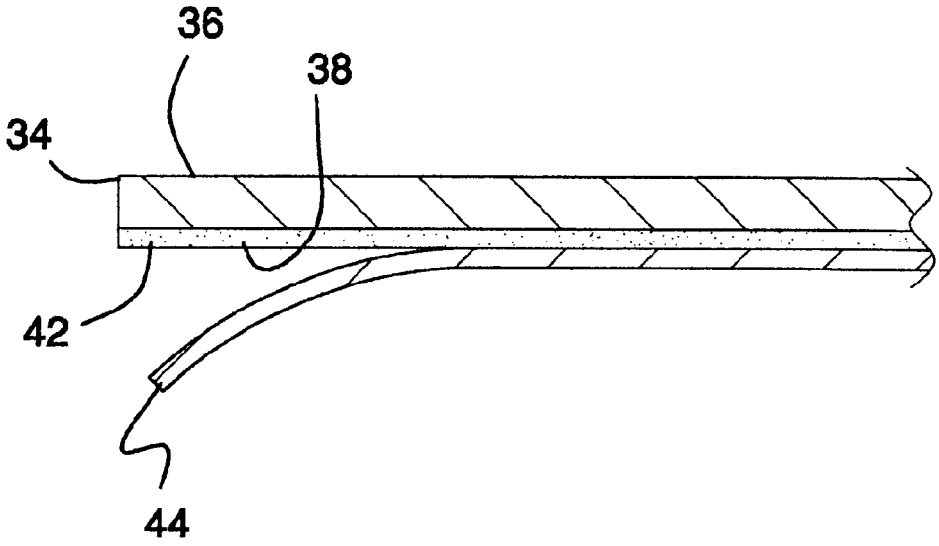
FIG. 4 is a schematic cross-sectional view of the panel of the present invention.

With reference now to the drawings, and in particular to FIGS. 1 through 4 thereof, a new design making device embodying the principles and concepts of the present invention and generally designated by the reference numeral 10 will be described.

As best illustrated in FIGS. 1 through 4, the design making toy 10 generally comprises a housing 12 having a bottom wall 14, an upper wall 16 and a peripheral wall 18 extending between the upper 16 and bottom 14 walls. The housing 12 has a door 20 removably positioned therein for selectively accessing an interior of the housing 12. The door 20 preferably takes the form of a cap which includes the bottom wall 14 and which is threadably coupled to the peripheral wall 18. The upper 16 and bottom 14 walls preferably each have a circular shape and a diameter of less than three inches so that a child may easily grip the housing 12.

A motor 22 is mounted in the housing 12. The motor 22 is positioned nearer the upper wall 16 than the bottom wall 14 and may be held in place by a peripheral flange 24 positioned within the housing 12. The motor 22 is preferably an electric motor. An actuator 26 is operationally coupled to the motor 22 for selectively turning the motor 22 on or off. Conventional batteries 28 may be positioned within the housing 12 for powering the motor 22.

An axle 30 is coupled to the motor 22 and extends upwardly through the upper wall 16. The motor 22 is adapted for rotating the axle 30 such that the axle 30 has a rotational axis orientated generally parallel to the upper 16 and bottom 14 walls. A platform 32 is attached to the axle 30 such that the axle 30 extends through the platform 32. The axle 30 is orientated substantially perpendicular to a plane of the platform 32. The platform 32 has a substantially circular shape and the axle 30 extends through an axis of the platform 32.

A panel 34 has an upper surface 36 and a bottom surface 38. The panel 34 has a centrally located aperture 40 extending therethrough. A conventional pressure sensitive adhesive 42 is positioned on and generally covers the bottom surface 38 of the panel 34. A selectively removably covering 44, or non-stick backing, is positioned on the adhesive 42.

In use, the panel 34 is removably positionable on the platform 32 such that the axle 30 extends through the aperture 40 and the upper surface 36 faces away from the platform 32. The platform 32 may be rotated and a writing utensil 46 positioned against the upper surface 36 such that a spiral design is positioned on the upper surface 36. The writing utensil 46 may be any conventional writing utensil including, but not limited to, pencils, markers, pens and the like. When the user has completed the desired design on the upper surface 36, the panel 34 is removed from the platform 32 and the covering 44 removed so that the panel 34 may be adhered to an object. It is preferred that the toy 10 includes a plurality of panels 34.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A design making assembly comprising:

a housing having a bottom wall, an upper wall and a peripheral wall extending between said upper and bottom walls;

a motor being mounted in said housing;

an axle being coupled to said motor and extending upwardly through said upper wall, said motor being adapted for rotating said axle;

a platform being attached to said axle such that said axle extends through said platform, said axle being orientated substantially perpendicular to a plane of said platform;

an actuator being operationally coupled to said motor for selectively turning said motor on or off; and a panel having an upper surface and a bottom surface, said panel having a centrally located aperture extending therethrough;

a pressure sensitive adhesive being positioned on and generallv covering said bottom surface of said panel, a selectively removably covering being positioned on said adhesive; and wherein said panel is removably positionable on said platform such that said axle extends through said aperture and said upper surface faces away from said platform, wherein said platform may be rotated and a writing utensil positioned against said upper surface such that a spiral design is positioned on said upper surface.

2. The design making assembly of claim 1, wherein said platform has a substantially circular shape, said axle extending through an axis of said platform.

* * * * *